United States Patent [19]

Kane et al.

[11] Patent Number: 4,591,393

[45] Date of Patent: May 27, 1986

[54] ALLOYS HAVING IMPROVED RESISTANCE TO HYDROGEN EMBRITTLEMENT

[75] Inventors: Russell D. Kane; James B. Greer; Dawn F. Jacobs, all of Houston, Tex.; Barry J. Berkowitz, Scotch Plains, N.J.

[73] Assignees: Exxon Production Research Co.; Exxon Research & Engineering Co., both of Houston, Tex.

[21] Appl. No.: 882,473

[22] Filed: Mar. 1, 1978

Related U.S. Application Data

[63] Continuation-in-part of Ser. No. 767,609, Feb. 10, 1977, abandoned.

[51] Int. Cl.[4] ..... C21D 9/14

[52] U.S. Cl. ..... 148/11.5 N; 148/425; 148/427; 148/442

[58] Field of Search ..... 148/13, 11.5 N, 12.7 N, 148/32, 32.5, 442, 425, 427

[56] References Cited

U.S. PATENT DOCUMENTS

| | | | |
|---|---|---|---|
| 3,645,726 | 2/1972 | Copson et al. | 148/13 |
| 3,767,385 | 10/1973 | Slaney | 148/32 |
| 4,026,583 | 5/1977 | Gottlieb | 29/421 E |

*Primary Examiner*—Melvyn J. Andrews
*Attorney, Agent, or Firm*—Michael A. Nametz

[57] ABSTRACT

Certain high strength alloys lacking resistance to hydrogen embrittlement are cold worked and heat treated utilizing critical preselected conditions to result in a unique alloy having increased resistance to hydrogen embrittlement without unacceptable loss of strength. It is theorized that this unexpected improved resistance correlates with the concentration of certain elements, such as phosphorus and sulfur as impurities on the crystallographic boundary surfaces of the alloy.

6 Claims, 3 Drawing Figures

ALLOYS HAVING IMPROVED RESISTANCE TO HYDROGEN EMBRITTLEMENT

CROSS REFERENCE TO RELATED APPLICATIONS

This application is a continuation-in-part of Ser. No. 767,609 filed Feb. 10, 1977 and expressly abandoned concomitant with the filing of the instant application.

BACKGROUND OF THE INVENTION

1. Field of the Invention

This invention relates to a process for heat-treating certain alloys within critical process parameters to increase the hydrogen embrittlement resistance of the alloys and to the improved alloys resulting from the application of the process.

2. Description of the Prior Art

A major obstacle to successful drilling and completion of deep wells for oil and gas is hydrogen sulfide. When oil or gas is contaminated with hydrogen sulfide they are referred to as sour, and these sour environments cause a number of problems. A principal problem associated with these sour environments is their tendency to cause brittle failure of the metals used in drilling and completing the wells. This brittle failure can be a problem particularly when using the high strength alloys needed for producing deep high pressure sour wells.

Brittle failure has been experienced with tubing, casing, drill pipes, wire lines, and related equipment. Sudden failure of such equipment can occur with little visible corrosion and no detectable plastic deformation. Moreover, brittle failures can occur in metals subjected to apparently safe loading and often after extended periods of satisfactory service. Such failures can result in loss or blowout of the well with disastrous consequences in terms of life and money.

Although the mechanism of such brittle failure is not fully understood, it is believed to be caused by entry of atomic hydrogen (H) into the metal. Hydrogen drastically reduces the ductility and causes the metal to crack. This phenomenon is commonly called hydrogen embrittlement. The mechanism of hydrogen embrittlement is more complex in the presence of hydrogen sulfide because of additional chemical reactions. In the presence of hydrogen sulfide, this mechanism is commonly called hydrogen sulfide embrittlement or sulfide stress cracking. The term hydrogen embrittlement, however, will be used herein in reference to brittle failure regardless of the hydrogen source.

Hydrogen sulfide is one source of the hydrogen and a common one. It may originate from water containing sulfur compounds, inflow of formation fluids, bacterial action on sulfates in drilling fluids, thermal degradation of drilling fluid additives and chemical reactions between sulfur compounds and metal. Hydrogen itself rather than hydrogen sulfide may be the cause of the brittle failure. Uncombined hydrogen can be generated from a number of sources including corrosion processes in the drilling fluids, bacterial action, and thermal degradation or organic additives.

Further discussion of hydrogen embrittlement problems is described in the following references.

Greer, J. B., "Metal Thickness and Temperature Effects in Casing and Tubing Design for Deep, Sour Wells", paper SPE 3968, presented at the SPE-AIME 47th Annual Fall Meeting, San Antonio, Tex., Oct. 11, 1972.

Watkins, M. and Greer, J. B., "Corrosion Testing of Highly Alloyed Materials for Deep Sour Gas Well Environments", paper SPE 5622, presented at SPE-AIME 50th Annual Fall Meeting, Dallas, Tex., Sept. 28–Oct. 1, 1975. This paper pointed out "the need to safely produce gas from deep (20,000 ft), high pressure (20,000 psi), high temperature (400°–500° F.) reservoirs containing high percentages of $H_2S$ and $CO_2$ along with salt water."

Greer, J. B., "Factors Affecting the Sulfide Stress Cracking Performance of High Strength Steels", *Materials Performance,* Vol. 14, pp. 11–22, January 1975.

Kane, R. D. and Greer, J. B., "Sulfide Stress Cracking of High-Strength Steels in Laboratory and Oilfield Environments", paper SPE 6144, presented at SPE-AIME 51st Annual Fall Meeting, New Orleans, La., Oct. 3–6, 1976.

Kane, R. D. and Greer, J. B., "Embrittlement of High-Strength, High-Alloy Tubular Materials in Sour Environments", paper SPE 6798 presented at SPE-AIME 52nd Annual Fall Meeting, Denver, Colo., Oct. 9–12, 1977.

Bates, T. R., "New Alloys for Use in High Pressure, Sour Gas Wells", Graduate Seminar at the University of Houston presented on Oct. 21, 1977.

Tuttle, R. N. (Shell Oil Co.) and Kochera, J. W., EFFECT OF HYDROGEN ON BEHAVIOR OF MATERIALS [Book] Metallurgical Soc. of AIME, New York; pp. 531–541, 1976; Abstr. No. 28784, ERDA ENERGY RES. ABSTR. v. 2, No. 12, p. 2953, June 30, 1977.

Nielsen, N. A. (du Pont de Nemours & Co.); "Stress Corrosion Cracking and Hydrogen Damage", MATER. PROBL. & RES. OPPORTUNITIES IN COAL CONVERSION WORKSHOP (Columbus, Ohio, 4/16/74) PROC. v. 2, pp. 397–418 [n.d.] (CONF-740473—P2); Abstr. No. 00138, ERDA REP. ABSTR. No. ERA 75/2, p. 7, April 1975.

U.S. Pat. No. 4,057,108 entitled "Completing Wells in Deep Reservoirs Containing Fluids That are Hot and Corrosive" highlights the intensely corrosive environment that alloys are subjected to in deep sour gas wells, but offers no suggestion for improving alloys. It does suggest the use of Multiphase MP35N alloy (available from Standard Press Steel Company).

U.S. Pat. No. 3,645,726 entitled "Resistance to Stress-Corrosion Cracking in Nickel Alloys" was previously cited by the Examiner in a parent application and does not teach the critical temperature limitations found by Applicants to give the superior alloy properties.

Several suggestions have been proposed to minimize equipment failure caused by hydrogen embrittlement. For example, inhibitor additives, protective coatings and metallurgical compositions have been proposed. Among the more promising metallurgical compositions proposed for use in deep sour wells are the highly alloyed metals such as high-strength super austenitic stainless alloys composed principally of nickel (and/or cobalt), chromium and molybdenum.

Other proposed methods to reduce embrittlement problems in conventional steel or alloy components include contacting the metal equipment with hydrogen sulfide at temperatures above 150° F., avoiding use of pipe that has been cold-straightened or cold-worked, using biocides to control sulfate reducing organisms, maintaining a high pH (9–10.5) within the well and using thicker wall pipe to reduce high stresses. Although the oil and steel industries have made significant efforts to resolve the hydrogen embrittlement problems of steels, most of the proposed methods are essentially ineffective to totally protect metal equipment from brittle failure.

As wells are drilled deeper and as higher concentrations of hydrogen sulfide are encountered at higher pressures, there is a substantially unfilled need for high-strength tubing material which has improved resistance to hydrogen embrittlement.

SUMMARY OF THE INVENTION

Hydrogen embrittlement resistance of certain high strength cold-worked alloys is substantially enhanced by critical heat treating of such alloys to achieve certain boundary segregation conditions of contaminant elements e.g. impurities. Heat treating the cold-worked alloys within a critical temperature range results in new alloy compositions as determined by impurity segregation which have been substantially improved in resistance to hydrogen embrittlement.

BRIEF DESCRIPTION OF THE DRAWINGS

FIG. 1 also illustrates the number of days the specimens were exposed to a hydrogen sulfide environment before fractures appeared in each specimen.

DESCRIPTION OF THE PREFERRED EMBODIMENTS

Figure 1:
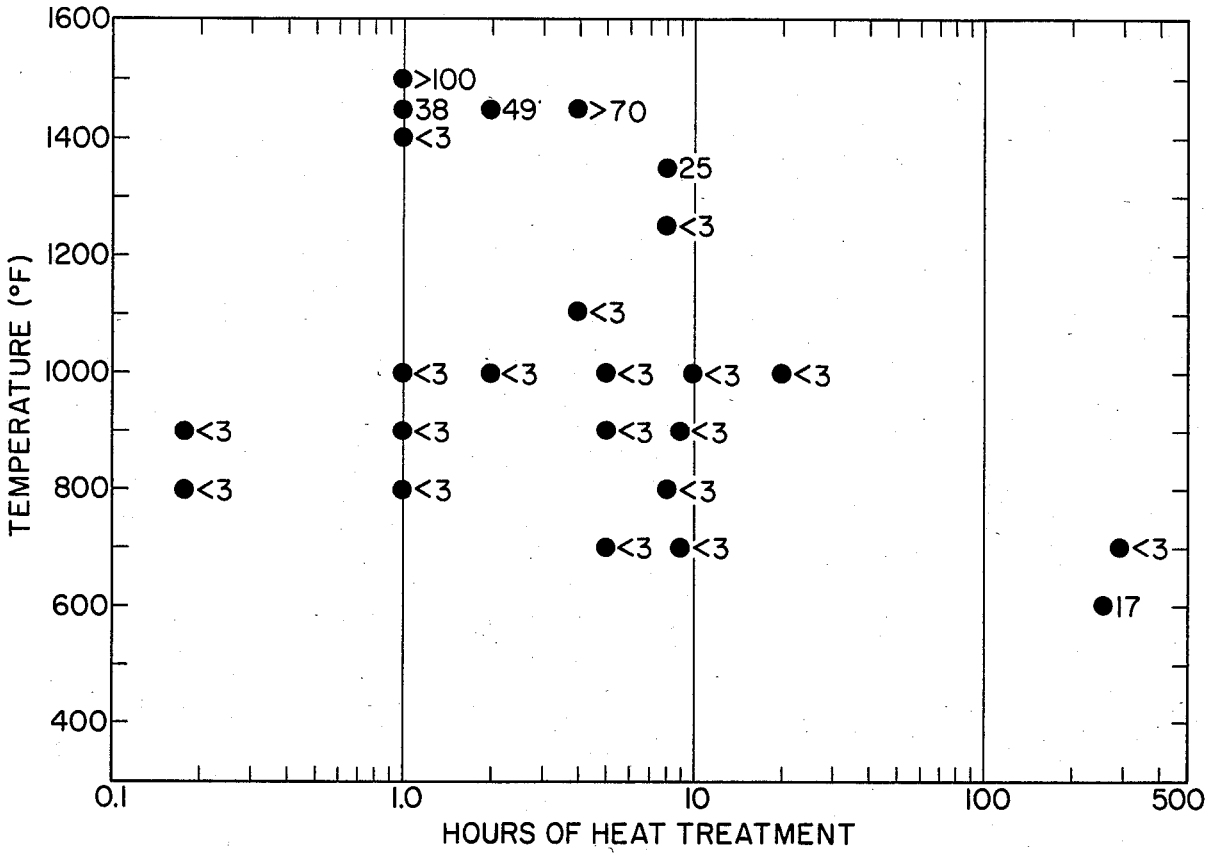
FIG. 1 plots the relation between heat treating temperature and hours of heat treating for several alloy specimens.

It is known generally that the hydrogen embrittlement susceptability of pure annealed nickel will be affected by the presence of tin and antimony impurity elements within the material. It has been discovered and described in the parent patent application that highly cold worked nickel and cobalt based alloys exhibit outstanding resistance to embrittlement in hydrogen producing environments as a direct result of heat treatment aging at critical times and critical temperatures. It is now realized and forms a feature of this invention that the critical temperature steps result in and are directly related to a segregation of impurities at the crystallographic boundaries of certain alloys. It is the segregation behavior of these impurities that permits the obtaining of a hydrogen resistant alloy from critical time/temperature treatments of certain cold-worked alloys. In essence, it has been found and is an important feature of this invention that heat treating can be selected to reduce segregation, e.g. concentration of certain tramp, trace elements at crystallographic boundaries. This is correlated with important improvements in resistance to hydrogen embrittlement.

Thus, the critical aging time steps are correlated with the boundary segregation characteristic of impurities to produce alloys having optimal resistance to hydrogen embrittlement. It follows that the outstanding effects of the critical heat treatments on certain alloys are found to be directly related to the lower impurity segregation level at major crystallographic boundaries which are obtained in the so-treated alloys. Therefore, the impurities which had been concentrated (segregated) become dispersed.

In effect, the critical control of impurities segregation can be achieved by the specified heat treatment with certain alloys such as high strength MP35N to produce a modified MP35N alloy composition which exhibits a substantially improved resistance to hydrogen embrittlement.

The key aspect for producing the high strength alloy having a heightened resistance to hydrogen embrittlement appears to be the heating of the cold-worked alloy material at a sufficiently high selected narrowly defined temperature for an adequate time period to reduce levels of impurities at crystallographic boundaries, e.g. reduce impurity level segregation.

However, there is an important balancing factor which is another key feature of this invention.

That is, the temperature treatment utilized to obtain the decreased levels of impurity segregation must be chosen so that it is below the recrystallization temperature of the particular alloy. The alloy which has been cold-worked will lose substantial strength and hardness if the temperature of treatment exceeds the recrystallization temperature. And the strength increase obtained by cold-working will be dissipated.

Thus, for the purpose of this invention where the object is to produce alloys with both high strength and improved resistance to hydrogen embrittlement, only those alloys in which the temperature for achieving adequate impurity desegregation levels is less than the temperature for recrystallization will be amenable to the heat-treating process step of the invention.

It is considered appropriate at this point to summarize the general characteristics of alloy materials of construction of extra high strength which are known to the art and their relationship to each other as follows:

I. Engineering Metals and Alloys

1. Ferrous Alloys
   a. Steel-low alloy and 12% Cr steel
   b. Precipitation hardened stainless steels
   c. Trip steels (cold work+age)
2. Nickel/Cobalt Base Alloys
   a. Nickel Base
      (i) Hastelloys C-276, G, X,
      (ii) Inconel 625,
   b. Nickel/Cobalt+Mo (MP-Multiphase)
      (i) MP35N
      (ii) MP159
   c. Nickel/Cobalt+Mo (low conc. Mo, Co)
      (i) Inconel 617
   d. Nickel/Cobalt+W (substitute for Mo)
      (i) Haynes 188
      (ii) Haynes 25
3. Aluminum Base Alloys
   a. Precipitation hardened alloys
4. Copper Alloys
   a. Cold worked+age (monel)

II. High Strength Alloys

1. Ferrous Alloys-low alloy steels (C-Mn steels and AISI 4130) appear promising.

Of the above alloy types, the particular species which are contemplated to have exceptional utility in the process and advantages of this invention are discussed below.

Certain high-strength Ni/Co base alloys are preferred alloys for the purposes of this invention. These alloys and their component elements are summarized below:

| | | Ni | Co | Cr | Mo | W |
|---|---|---|---|---|---|---|
| 1 | MP35N | 35 | 35 | 20 | 10 | — |
| 2 | Haynes 188 | 22 | Bal | 22 | — | 14 |
| 3 | Haynes 25 | 10 | Bal | 20 | — | 15 |
| 4 | Inconel 617 | 54 | 12.5 | 22 | 9 | — |

The nickel component of the alloy tends to give high strength and corrosion resistance. The cobalt component tends to give the alloy good cold-work strengthening characteristics.

All the above preferred alloy materials are initially single phase alloys with a face-centered cubic crystal structure. They are strengthened by cold working which is performed during processing (work strengthening, strain hardening). Typical yield strengths attainable with these materials are in a range of 150 to 225 ksi. At these strength levels, hardness values are typically 35 to 43 HRC (Rockwell "C" hardness) [345 to 425 DPH (Diamond Pyramid Hardness)]. These nickel/-cobalt base alloys can be strengthened further by aging at temperatures between 400° and 1250° F. Increases in yield strength resulting from this aging operation are between 5 to 15% of the as-cold worked values. Therefore, aged yield strengths are between 160 and 260 ksi [hardness 37 to 52 HRC (365 to 545 DPH)].

Heat treatment as disclosed in this application (1300°-1600° F., preferably 1350°-1500° F.) results in materials with slightly reduced strengths in the lower ranges of the materials in the unaged condition. (Typical yield strengths are between 150 to 225 ksi). Therefore the heat treatment has a slightly adverse effect on strengths, but the drastic increase in hydrogen embrittlement resistance more than compensates for this minor disadvantage.

Hastelloy C-276 and Inconel 625 are nickel-base alloys which are strengthened by cold working to similar levels as discussed for nickel-cobalt base alloys. These materials show a small strengthening response to aging in the temperature range 400° to 1200° F. (increase in yield strength typically 0-10 percent). Heat treatment in the temperature range 1350°-1550° F. showed slightly reduced strength levels but hydrogen embrittlement tests showed no evidence of improvement to hydrogen embrittlement after such heat treating. No improvement was found even at temperatures near the recrystallization temperature (1550°-1600° F.) where rapid loss in strength was observed.

Experiments were conducted to determine the grain boundary segregation of Hastelloy C-276 following aging at 1450° F. for 8 hours (data is already available following aging at 900° F./100 hrs.). According to our correlation between boundary impurity levels and hydrogen embrittlement resistance no decrease in segregated impurities following 1450° F./8 hrs was observed.

U.S. Pat. No. 4,245,698, issued Jan. 20, 1981 to two of the co-inventors hereof, B. J. Berkowitz and R. D. Kane, entitled SUPERALLOYS HAVING IMPROVED RESISTANCE TO HYDROGEN EMBRITTLEMENT, describes and claims other techniques for achieving resistance to hydrogen embrittlement in Hastelloy C-276 and other alloys having high strength which alloys do not show a response from a high temperature treatment.

Precipitation hardened steels are contemplated to be responsive to the techniques of the present invention. Also, 12% Cr steels have severe problems from hydrogen embrittlement and may be improved with the technique of the invention. Trip steels are probably closest in response to Ni/Co base alloys, because they are cold worked and aged similar to Ni/Co base alloys and therefore may also respond similarly during thermal treatment.

As to Nickel/Cobalt base alloys, improvements in hydrogen embrittlement resistance of MP35N, Haynes alloy 188 and 25 have been demonstrated. Hastelloy C-276 and Inconel 625 do not show this effect upon heat treating. Hastelloy G and X are slightly lower in strength and also have improved hydrogen embrittlement resistance by virtue of having high iron contents.

As to aluminum-base alloys and titanium alloys, there is possibly some application of the invention technology to some precipitation hardened aluminum alloys, but such alloys are not of high engineering interest at the present time.

As to copper base alloys, most are not considered to be of engineering significance. However, if cold worked Monel (Nickel-Copper) achieves fairly high stress level, heat treating this alloy should give good hydrogen embrittlement resistance in non-$H_2S$ environments (in $H_2S$ copper alloys tend to corrode).

In accordance with the practice of this invention, a method is described for heat treating a class of cold work-strengthened alloys. It has been discovered that a surprising increase in resistance to hydrogen embrittlement of these work-strengthened alloys can be achieved by heat treating the alloys to a temperature within a certain critical temperature range for a time period within the range of $\frac{1}{4}$ to 100 hours. This increased resistance is correlated with a corresponding decreased level of impurity segregation at crystallographic boundaries.

The especially preferred alloys of this invention before heat treating have the following percentage composition by weight:

| | |
|---|---|
| chromium | 10%-25% |
| molybdenum and/or tungsten | 0%-20% |
| iron | 0%-10% |
| cobalt | 0%-50% |
| aluminum | 0%-0.5% |
| columbium | 0%-4% |
| titanium | 0%-3% |
| nickel | Balance |

The following discussion is in respect to the especially preferred alloys, but the invention is not to be so limited.

As noted, the balance of the above especially preferred composition is nickel, except for incidental impurities which preferably are kept low. The nickel content of the alloys should always be at least 30% by weight of the alloys.

Molybdenum may be present in the alloys described above to provide high resistance to pitting corrosion and to provide solid-solution strengthening. Alloys having molybdenum compositions above about 20% tend to have unacceptably low ductility.

Chromium is also present in the alloys to provide corrosion resistance and solid-solution strengthening. However, the chromium should not exceed 25% because the ductility decreases substantially at compositions above this, particularly when the alloy is cold-worked.

Iron may be present in amounts up to 10% but should not exceed this concentration because higher concentrations tend to reduce the corrosion resistance of the alloy.

Cobalt may be added to the alloy to enhance solid solution and work-strengthening, however, the composition should not exceed about 50% because of low ductility at higher concentrations.

The aluminum and titanium compositions should be kept low in order to prevent gamma prime ($\gamma'$) precipitation hardening of the alloy. As will be discussed later herein, the alloys of this invention are not strengthened by precipitation hardening.

Examples of impurities and incidental elements which may be contained in the alloys of this invention include boron, silicon, phosphorous, sulfur, manganese and carbon with each element being present in amounts up to about 0.5 to 1% (usually Atomic percent). These incidental elements may be added to improve forging properties, strengthening, corrosion resistance or for other benefits. It is more likely that they are present as tramp elements because it is not technically feasible to reduce the amount of these elements below the stated amounts above.

The alloys of the class described above may be work-hardened by any form of mechanical deformation processing such as forging, rolling, drawing, spinning or bending. The terms "cold-work" and "work-strengthen" are used synonymously herein to mean mechanical deformation carried out on a metal below its recrystallization temperature to produce permanent strain in the metal. This recrystallization temperature is generally considered to be the minimum temperature in which a totally new grain structure will appear in the cold-worked alloy within a specified time. The degree of cold-working of the alloys of this invention can generally vary within a range from about 15% to about 90% reduction in area.

Several cold-worked alloys of this invention are available commercially. Such alloys include cold-worked alloys having percentage compositions by weight as shown below in Table I.

TABLE I

| Element | MP35N | Hastelloy$\phi$ C-276 | Hastelloy$\phi$ C-4 | Inconel† 625 |
|---|---|---|---|---|
| Cr | 20.0 | 15.5 | 16.3 | 21.5 |
| Ni | Balance | Balance | Balance | Balance |
| Fe | 0 | 5.5 | 0 | 2.5 |
| Al | 0 | 0 | 0.2 | 0.2 |
| Ti | 0.5 | 0 | 0.5 | 0.2 |
| Mo | 10.0 | 16.0 | 15.3 | 9.0 |
| Cb | 0 | 0 | 0 | 3.65 |
| Co | 35.0 | 2.5 | 0 | 0 |
| W | 0 | 3.8 | 0 | 0 |
| V | 0 | 0 | 0.20 | 0.05 |
| C | 0.015 | 0.02 | 0.02 | 0.05 |
| B | 0.015 | 0 | 0 | 0 |
| Mn | 0 | 1.0 | 0 | 0.25 |
| Si | 0 | 0.05 | 0.05 | 0.25 |

Registered Trademarks
Standard Pressed Steel Co.
$\phi$Cabot Corporation
† Huntington Alloys, Inc.

If cold-worked alloys of the above class are not commercially available, a convenient procedure for preparing an alloy is as follows. Predetermined proportions of the alloy components of this invention are melted in a vacuum induction furnace at a temperature sufficient to melt the components. The alloy can also be melted in an electro slag remelt furnace or in an open-air induction furnace. The alloy melt is then cast in an ingot mold. Subsequently, the alloy is cold-worked at a temperature below the alloy's recrystallization temperature. Normally, the recrystallization temperature is not a fixed temperature, but a range depending on such variables as the initial grain size, composition, amount of previous cold-work, temperature cycle and time. After the alloy has been suitably cold-worked, it is then heated at a temperature within the range of about 1300° F. to about 1600° F. for a time period within the range of about ¼ to about 100 hours. This heat treating process will be described in greater detail hereinafter. However, prior to discussing the heat treating process the factors governing the hardening and strengthening of these alloys will be briefly reviewed.

In general, hardening and strengthening of metals depends on the chemical composition and then on the mechanical and thermal processing of the metal. Mechanical and thermal processes may include casting, sintering, hot working, cold-working and various heat treatments. Such processing steps influence mechanical properties by their effect on grain size, inclusions, voids, size and distribution of phases and lattice imperfections.

The alloys of the invention are strengthened and hardened primarily by solid-solution strengthening and cold-working. Solid-solution strengthening of alloys is generally imparted by elements such as tungsten, molybdenum, tantalum, columbium and chromium. These strengtheners are primarily found in the matrix phase of the processed alloys. As discussed previously, the alloys heat treated in accordance with this invention are solid-solution strengthened primarily by molybdenum and chromium.

Cold-working the solid-solution strengthened alloys further increases the alloys' hardness and yield strength. However, unless the cold-worked alloys are heat treated in accordance with this invention, they tend to have a high susceptibility to embrittlement in hydrogen environments.

Although nickel-based alloys are commonly hardened and strengthened by carbide precipitation and gamma prime ($\gamma'$) phase precipitation, the heat treated alloys of this invention are not precipitation hardened by $\gamma'$ or carbide phases. Carbide precipitation is generally promoted through the addition of carbide forming elements such as titanium, columbium and hafnium to the alloy. Precipitation of the $\gamma'$ phase is effected through the addition of elements needed to form this phase, principally aluminum and titanium, although limited quantities of other elements may be found in this phase. The $\gamma'$ phase is usually represented by the formula $Ni_3$ (Al, Ti). Heat treated alloys of this invention have a low aluminium and titanium composition to prevent formation of the gamma prime precipitates.

Generally, solid-solution strengthened nickel-chromium-molybdenum alloys may be further strengthened by aging at temperatures from 800° F. to 1200° F. It has been suggested that this strengthening is the result of the formation of ordered phase such as $Co_3Mo$ or $Ni_2$ (CrMo). As described in Matthews, "Thermal Stability of Solid Solution Strengthened High Performance Alloys", *Structure and Properties of Materials,* Vol. 3, pp. 215–226, Hastelloy Alloy C-4 has maximum strength when aged at about 1000° F., and aging the alloy at temperatures above 1100° F. causes its strength to decrease. Although the heat treated alloys of this invention have less strength than alloys aged at temperature of about 900°-1100° F., the heat treated alloys of this invention have adequate strength and hardness for use as well equipment and many other high strength applications. It should also be understood that these can be employed in any hydrogenating environment.

The mechanical properties of MP35N following various heat treatments are shown below in Table II. The table illustrates that MP35N heat treated within the temperature range of 1300° F. to 1600° F., preferably 1350° F. to 1500° F. had high strength and ductility.

TABLE II

| Mechanical Properties of MP35N with Various Heat Treatments | | | |
|---|---|---|---|
| Heating Temp/ Heating Time | Yield Str (Ksi) | Tensile Str (Ksi) | % elongation |
| No heat treatment | 186 | 210 | 17.3 |
| 1100° F./4 hrs. | 238 | 246 | 8.7 |
| 1250° F./8 hrs. | 223 | 230 | 13.6 |
| 1350° F./8 hrs. | 195 | 213 | 17.5 |
| 1400° F./16 hrs. | 192 | 209 | 18.7 |
| 1450° F./4 hrs. | 180 | 197 | 27.7 |
| 1500° F./1 hr. | 162 | 188 | 19.0 |

After obtaining one alloy of desirable composition and cold-working history, it is subjected to the heat treatment process. During the heat treatment, the temperature of the metal is raised to within the range of about 1300° F. to about 1600° F. and is maintained within this range from a period of time of from about ¼ to about 100 hours. Preferably, the heat treatment is within the range of 1300° F. to 1500° F. and most preferably 1400° F. to 1500° F. and has a duration of from ¾ to 20 hours most preferably 5 to 15 hours.

The procedure for the heat treatment can vary broadly and can be adjusted by one skilled in the art to best accomplish the ends of producing an alloy which has improved resistance to brittle failure. During the process the alloy may be placed in a treatment room, if desired, to assist in obtaining an even distribution of heat and to conserve heating energy. This would be particularly desirable where the heat treatment was applied to relatively small quantities of metal. However, where the alloy quantities are relatively large other accommodations may be preferable such as an open air induction furnace.

The alloy may be exposed to the open air during the heat treatment without deleterious results. However, where it is desired the alloy may be enclosed in an inert gas environment.

The means for heating may be selected from those readily available. Electricity and natural gas are common heat sources which may be used to supply the necessary heat.

The temperature level need not remain constant during the heat treatment and need not be completed in a single step. For example, the alloy may be heated for a period of time at one temperature within the range of 1300° F. to 1600° F., and subsequently the temperature may be changed to one or more levels within the range until the heat treatment is terminated.

The optimum temperature level and the duration of the heating varies with a number of factors including the precise composition of the alloy, intensity and duration of cold-working of the alloy prior to the heat treatment, and desired degree of resistance to brittle failure of the final product. Substantial improvement in the resistance to brittle failure of cold-worked alloys can be obtained by heat treatment of the alloys anywhere within the ranges specified. However, the treatment can be optimized by routine experimentation. A number of samples of alloys having the same composition and having the same cold-working history can be heated to several levels within the range of about 1300° F. to about 1600° F. for various durations of time. Preferably, a number of samples at a given temperature level will have various heat treatment durations to isolate the effect of treatment length. All the heat-treated alloys are then subjected to testing as described in the following sections—Experimental Tests and Examples illustrating the Effect of Impurity Segregation—to determine the optimum heat treatment for a particular alloy. Other alloys having differing compositions and differing cold-working histories may be subjected to such routine experiments to determine optimum temperature levels and treatment length for each alloy.

Certain conditions should, of course, be avoided during the heat treatment. The alloy should not be subjected to such radical changes in temperature that undesirable stress are created in the alloy. Similarly, the alloy should not be exposed to highly corrosive materials or those which would adversly interact with the alloy during the heat treatment.

EXPERIMENTAL TESTS

The following series of tests are offered to demonstrate the surprising and unexpected results of heat treating a cold-worked alloy in accordance with the practice of this invention. The alloy examined in these tests was obtained from commercial tubing which had a chemical composition as shown below in Table III. The tubing had been cold-worked from 50 to 63% reduction in area prior to testing and had been aged at temperatures between 900° F. and 1200° F.

TABLE III

| MP35N | |
|---|---|
| Element | Percentage Composition by Weight |
| Cr | 19.9 |
| Ni | Balance |
| Fe | 0.34 |
| Ti | 0.82 |
| Mo | 9.5 |
| Co | 34.4 |

Trademark registered to Standard Pressed Steel Company

C-ring specimens were cut from a cross section of the cold-worked tubing. The size and thickness of the rings were determined by the size and thickness of the tubing.

Figure 3:
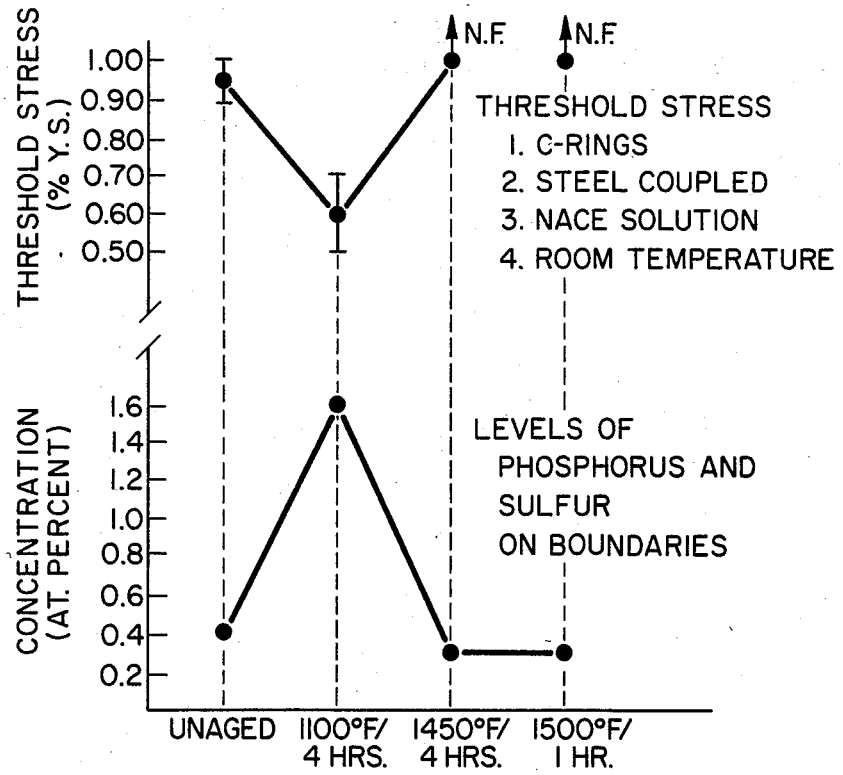
FIG. 3 shows the relationship of boundary impurity composition levels to hydrogen embrittlement.

The C-rings were heat treated in air at the times and temperatures illustrated in FIG. 3 which plots the relation between hours of heat treatment and the heat treatment temperature. The heating was conducted in an electric resistance furnace manufactured by Lindberg Corporation (types 51662 and 59344). The time and temperature for heat treating the specimens are representated in FIG. 3 by solid circles. Each circle represents one specimen, except that the circle having coordinates (1 hour, 1500° F.) represents four specimens and the circle having coordinates (4 hours, 1450° F.) represents two specimens. The specimens were removed from the furnace after the specified time period and they were either air cooled or water quenched to room temperature.

The C-rings were then stressed at 90 and 100% of the transverse yield strength of the materials by means of Hastelloy Alloy C bolts through the diameter of the C-rings. The yield strength was defined as the stress corresponding to 0.2% offset strength measured in a tensile test. To cathodically charge the C-rings during the test, several steel nuts were placed on the bolts to serve as a steel anode. An additional steel couple was connected to the stressed portion of the C-ring.

The stressed heat treated rings were placed in an aqueous $H_2S$ environment which was prepared in accordance with the proposed NACE standard test method for evaluating metallic materials for sulfide stress cracking at an ambient temperature as described by J. B. Greer in paper number 97 presented at the NACE Corrosion meeting in Toronto, Canada, Apr. 14–18, 1975. This procedure produced an oxygen-free, $H_2S$ saturated, aqueous solution containing 5% NaCl and 0.5% acetic acid by weight. Oxygen was initially removed from the solution by purging it with nitrogen. Before the specimens were introduced, hydrogen sulfide was then bubbled through the solution for a period of 24 hours. The hydrogen sulfide bubbling was maintained throughout the test. The solution and specimens were maintained at room temperature (72° F., plus or minus 10° F.) and the tests were conducted at approximately atmospheric pressure.

The specimens were visually examined for cracking by removing them from the bath at regular intervals. Testing was continued until failure of the specimens occurred or until 100 days had elapsed. Visual inspection of the C-ring outer surface was used to determine if cracking had begun. The number of days before fractures were first observed are shown in the FIGURE by the numerals adjacent each solid circle. For example, the specimen heated for one hour at 1000° F. failed in less than 3 days, the specimen heated for one hour at 1450° F. failed at 38 days, and the specimens heated for 1 hour at 1500° F. did not fail during the 100 day test. The cold-worked alloys are subjected to a heat treatment within the range of 1300° F. and 1600° F. for a time interval within the range of from ¼ to 100 hours. Heat treating the cold-worked alloys within this critical temperature range substantially improves resistance of the alloys to hydrogen embrittlement.

EXAMPLES ILLUSTRATING THE EFFECT OF IMPURITY SEGREGATION

In the following example runs, the effect of heat treatment on the hydrogen embrittlement susceptibility of cold-worked MP35N was examined using C-ring specimens. In contrast to the detrimental effects of low-temperature aging reported previously, it was found that increased resistance to hydrogen embrittlement could be obtained in high-strength MP35N by application of an elevated-temperature heat treatment. The effects of heat treatment are directly related to impurity segregation behavior occurring at the major crystallographic boundaries.

EXPERIMENTAL PROCEDURE

MP35N is primarily strengthened by high degrees of cold-working, which increase the yield strength of the material routinely into the range 1034 to 1551 MPa (150 to 225 ksi). In the following examples, MP35N was obtained in tubular form with cold reductions (CR) of 51, 59, and 63 percent. MP35N (51% CR) was aged at 593° C. (1100° F.)/4 hrs at the mill. The remaining materials were obtained in the unaged condition. Chemical compositions of these materials were essentially those set forth in Table III. Typical mechanical properties are indicated in Table II.

To evaluate the hydrogen embrittlement behavior of treated and untreated MP35N in hydrogen sulfide environments, C-ring specimens were tested as described above. Briefly reviewed, the specimens were heat treated at temperatures between 149° and 816° C. (300° and 1500° F.). They were then stressed and placed in an aqueous solution containing 5 percent NaCl, 0.5 percent acetic acid, saturated with $H_2S$ at room temperature (i.e., NACE solution). The C-rings were cathodically charged by galvanic coupling to steel.

To determine the effects of impurity segregation, scanning Auger spectroscopy was conducted on hydrogen-embrittled samples of MP35N. This procedure consisted of hydrogen charging notched beam specimens at room temperature in a 5 percent $H_2SO_4$ solution containing 100 mg/l sodium arsenite. The charging was performed at a current density of 100 to 250 mA/cm$^2$ for a period of 3 to 5 days. Following hydrogen charging, the samples were cadmium plated and placed in ultrahigh vacuum ($\leqq 10^{-9}$ torr), where they were physically (mechanically) fractured in situ by hitting the notched specimen with a hammer activated steel member. The Auger analysis was conducted on the embrittled fracture surfaces of these samples using a Physical Electronics Model 590 Scanning Auger Microprobe (SAM). The beam excitation voltage was 8 KeV with a current with the range of 2 to 3 $\mu$A. The beam diameter was typically 0.2 $\mu$m.

The effects of heat treatment time and temperature on the hydrogen embrittlement susceptibility of cold-worked MP35N have been shown in FIG. 1. As has been discussed, following low-temperature aging at 204° to 593° C. (400° to 1100° F.) for times ranging between 10 minutes to over 200 hrs, MP35N was very susceptible to failure in NACE solution when stressed to 100% of its transverse yield strength and coupled to steel. The time-to-failure for all specimens aged in this temperature range was consistently less than three days. The embrittlement threshold stress (i.e., maximum no-failure stress) decreased from 90% of the yield strength for the unaged MP35N to 70% of the yield strength for this material following aging at 204° C. (400° F.) for 250 hrs. Aging at 593° C. (1100° F.) for 4 hrs decreased the embrittlement threshold stress still further.

In comparison to the detrimental effects of low-temperature aging, there was substantial improvement in the resistance to hydrogen embrittlement of MP35N following elevated-temperature heat treatments conducted in the temperature range 677° to 816° C. (1200° to 1500° F.). As shown in FIG. 1, the time-to-failure for stressed, steel-coupled specimens increased very rapidly with increased heat treatment temperature above 732° C. (1350° F.). Heat treating at temperatures between 760° and 816° C. (1400° and 1500° F.) for times of 1 to 16 hrs resulted in no-failure behavior in specimens stressed to 100% of transverse yield strength and exposed to NACE solution for more than 100 days.

The effect of aging in the temperature range 204° to 480° C. (400° to 900° F.) subsequent to heat treatment of MP35N (59% CR) at 816° C. (1500° F.) for 1 hr was determined. This heat-treated condition of MP35N was found to be very resistant to embrittlement in NACE solution after the low-temperature aging. In addition, over 30 specimens of MP35N heated at various temperatures between 760° and 816° F. (1400° and 1500° F.) for 4 to 16 hrs followed by aging at 260° C. (500° F.) for 250 hrs have been tested for over 100 days in NACE solution with steel couples and stressed to 100 percent of transverse yield strength without failure. Without the high-temperature heat treatment, failures occurred after relatively short exposure times.

Micrographs of cold-worked MP35N following various aging treatments were obtained to indicate microstructural characteristics. Using light-optical microscopy, no major distinction could be made between MP35N in the (1) unaged condition, (2) aged at 593° C. (1100° F.)/4 hrs, or (3) aged at 788° C. (1450° F.)/4 hrs. All conditions of MP35N exhibited similar elongated grain structures containing many anneal twins. The slip planes etched readily in most grains. Specimens of MP35N that were heat treated at 816° C. (1500° F.) for 1 hr had localized areas of fine recrystallized grains. These were located in the more heavily cold-worked areas near the outer surface of the tube. Scanning electron micrographs were taken of the fractures in MP35N produced by hydrogen charging in NACE solution showed the fractures appeared to follow the grain and twin boundaries. In some cases, the fractures also followed the micro-twin boundaries existing in the fine structure of the material.

Figure 2:
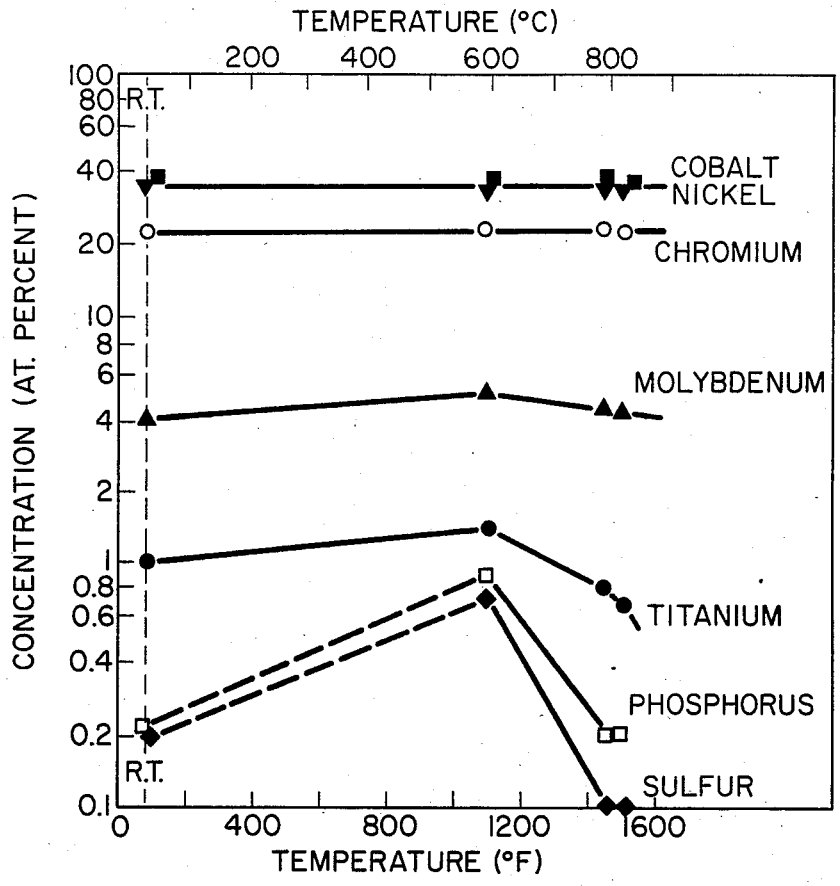
FIG. 2 shows the effect of heat treatment on boundary composition.

Auger spectra were obtained from the embrittled regions of the fracture surfaces of hydrogen charged specimens of MP35N; they indicated the presence of the major alloying elements (Ni, Co, Cr., Mo) along with significant amounts of Ti, P, and S. The combined data from all conditions of MP35N analyzed are shown graphically in FIG. 2. The concentrations of Ni, Co, Cr, and Mo were essentially constant with only minor variations in the Ti and Mo concentrations noted following heat treating at temperatures between 593° to 816° C. (1100° to 1500° F.).

In general, levels of P and S segregated on the fracture surfaces (major crystallographic boundaries) were between 100 and 1000 times the bulk concentrations [i.e., 0.002–0.008 At. % (0.001–0.004 wt %)] in the alloy specimen. Bulk concentration as used herein means the total number of given element impurity atoms divided by the total number of atoms in the alloy. The term fracture surfaces is intended to mean major crystallographic boundaries. Significant changes in the fracture surface concentration of these elements occurred as a result of heat treatment. In the unaged materials, the fracture surface concentrations of P and S were approximately 0.2 At % and 0.2 At. %, respectively. Upon aging at 593° C. (1100° F.) for 4 hrs, the concentration of these elements at the fracture surfaces increased to 0.9 At. % for P and 0.7 At. % for S. Combined levels of P+S were 1.6 At. % at the fracture surfaces following this aging treatment. Heat treating at 788° C. (1450° F.) and 816° C. (1500° F.) produced a substantial decrease in the levels of P and S to 0.1 At. % and 0.2 At. %, respectively at the fracture surfaces. The levels of P and S on the fracture surfaces following these heat treatments were at the lower detectibility of the equipment and may have been lower than indicated.

The data herein indicate that the susceptibility of cold-reduced MP35N to hydrogen embrittlement is substantially affected by heat treatment. As shown in FIG. 3, Auger data reveal that the embrittlement behavior of this alloy correlates with the concentration of impurities on the major crystallographic boundaries.

Specifically, heat treatments that promoted high levels of P and S segregation at the fracture surfaces [593° C. (1100° F.)/4 hrs.] produced materials which exhibited poor resistance to hydrogen embrittlement. Segregation e.g., concentration of some impurity elements have been found to promote the embrittlement of many alloys both in air and in hydrogenating environments.

High-strength, cold-reduced MP35N appears to be very sensitive to very small amounts of P and S impurities segregated at crystallographic boundaries. Concentrations of P+S for MP35N following aging at 593° C. (1100° F.) for 4 hrs approached two percent at the fracture surfaces. Whereas these amounts are relatively small, they have significant effects in determining the embrittlement behavior of the material. In addition, they are, in fact, between 100 to 1000 times the bulk concentration of these elements at the fracture surfaces in MP35N. Similar results have been observed by others for the effects of impurities in high-strength steels. Relatively minor changes in grain boundary impurity levels have been shown to significantly change the susceptibility of these materials to hydrogen embrittlement.

It is not possible at present to separate the effects of P and S segregation in MP35N. It is not known whether only one species (P or S) is damaging to hydrogen embrittlement resistance in MP35N or whether they both contribute to this process. It is contemplated by the inventors that the effects of these elements could be separated by experiments conducted on heats of MP35N in which the levels of P and S are independently varied.

Untreated MP35N exhibits increased susceptibility to hydrogen embrittlement following long-term, low-temperature aging at both 204° C. (400° F.) and 371° C. (700° F.). Due to the low diffusivities of substitutional elements at these low temperatures, it would normally be very unusual for impurity elements such as P and S to segregate at the crystallographic boundaries in MP35N at temperatures as low as 204° C. (400° F.). However, the material tested was cold-reduced in excess of 50 percent prior to testing. As a result, the defect density in this material was very high (i.e., a large number of vacancies and high dislocation density). It has been established by the inventors hereof that these features of highly cold-worked materials can greatly enhance diffusion of substitutional elements. Consequently, it has been theorized by the present inventors that low-temperature aging could result in the segregation of P and S in MP35N and greater susceptibility to hydrogen embrittlement.

Thus, it has been found and forms an essential feature of this invention that control of impurity segregation and hydrogen embrittlement in MP35N can be achieved by critical heat treatments so that high-strength MP35N can be produced which exhibits outstanding resistance to hydrogen embrittlement. The effect of heat treatment on the hydrogen embrittlement behavior of MP35N is shown in FIG. 3. This figure indicates that following heat treating at elevated temperatures [760°–816° C. (1400°–1500° F.)], the levels of boundary impurity segregation decrease. As a consequence, resistance of the material to hydrogen embrittlement increases.

The mechanism attributable for the decrease in boundary impurity segregation at elevated temperature is not completely understood. However, it appears as a theory that is could be related to (1) the gathering of impurities at innocuous sites (i.e., second-phase particles and other discontinuous interfaces), (2) movement of boundaries away from impurity-rich areas, and/or (3) redissolving impurities into the alloy solution.

To further understand the processes occurring during elevated-temperature heat treatments, transmission electron microscopy (TEM) was employed. Comparative micrographs were taken for MP35N heat treated at 593° C. (1100° F.)/4 hrs and at 788° C. (1450° F.)/4 hrs. The microstructures produced by the various heat treatments differed in two respects. First, the twin boundaries, which were well defined and straight as a result of aging at 593° C. (1100° F.)/4 hrs, appeared irregular and wavy after the 788° C. (1450° F.)/4 hrs heat treatment. They had the appearance of having been active and mobile during the higher temperature heat treatment.

Secondly, the MP35N has a much lower dislocation density as a result of the 788° C. (1450° F.)/4 hrs heat treatment (i.e. recovery has taken place). There were no significant differences in the size and distribution of inclusions or other second phase particles. Therefore, it appears that the reduction in the levels of impurity segregation is a result of exposing the alloy to a temperature where the P and S impurities go back into the alloy solution or where the boundaries are mobile enough to leave the impurities behind.

The improved resistance to subsequent low-temperature aging following elevated-temperature heat treatments appears to be the result of recovery taking place at the high temperatures. The resultant lower defect density would tend to reduce the diffusion rates of substitutional elements to conventional levels and make resegregation even at at low temperatures unlikely.

It has been found and forms the substance of this invention that the critical aspect of producing high-strength MP35N with high resistance to hydrogen embrittlement is the heating of the cold-worked alloy material at a sufficiently high temperature within narrowly defined ranges for an adequate time period to reduce levels of impurity segregation. Moreover, it is important that this temperature must be maintained below the recrystallization temperature where substantial loss in strength and hardness would occur. Whether or not a particular cold-reduced material will exhibit improved resistance to hydrogen following the teachings of this invention will depend on the relationship between the temperature for impurity desegregation, ($T_{DS}$), and the recrystallization temperature, ($T_R$). For the case where $T_{DS}<T_R$, both high strength and high resistance to hydrogen embrittlement can be achieved. However, where $T_R<T_{DS}$, the material will probably lose too much strength and thus offset beneficial hydrogen resistance effects of the heat treatment described herein.

The invention has been described in particularity with respect to the MP35N alloy as the preferred embodiment and best mode, nevertheless, the principles of the inventive technique are applicable to many other alloys as discussed above and will be obvious to one skilled in the art after reading the disclosure herein.

Various modifications and alterations to this invention will become apparent to those skilled in the art without departing from the scope and spirit of this invention and it should be understood that this invention is not unduly limited to the series of tests described herein for illustrative purposes.

We claim:

1. A tubular metal product for use in sour gas wells characterized by resistance to hydrogen sulfide embrittlement at temperatures up to about 500° F. consisting essentially of an alloy having the composition 0.015% carbon, 19.9% to 20.0% chromium, 34.47% to 35.03% nickel, 9.5% to 10.0% molybdenum, 0.5% to 0.82% titanium, 0.015% boron, 0% to 0.34% iron, and the balance cobalt, except for impurities, said tubular product having been cold worked at least sufficiently to impart increased strength and from 50% to 63% and thereafter heat treated in the range 1350° F. to 1500° F.

2. A tubular metal product as claimed in claim 1 wherein the alloy composition is 0.015% carbon, 20.0% chromium, 35.03% nickel, 10.0% molybdenum, 0.5% to 0.82% titanium, 0.015% boron, 0% to 0.34% iron, and the balance cobalt, except for impurities.

3. A tubular metal product as claimed in claim 1 wherein said product has been heat treated in the range 1400° F. to 1450° F. after cold working from 50% to 63%.

4. A method for producing a tubular metal product suitable for use in sour gas wells and characterized by resistance to hydrogen sulfide embrittlement at temperatures up to about 500° F. comprising the steps of:

(a) forming a tubular metal member from an alloy consisting essentially of 0.015% carbon, 19.9% to 20.0% chromium, 34.47% to 35.03% nickel, 9.5% to 10.0% molybdenum, 0.5% to 0.82% titanium, 0.015% boron, 0% to 0.34% irons and the balance cobalt, except for impurities, (b) cold working said tubular metal member in the range 50% to 63%, (c) heat treating said cold worked tubular member in the range 1350° F. to 1500° F. when the cold working is in the range 50% to 63%.

5. A method as claimed in claim 4 wherein the alloy consists essentially of 0.015% maximum carbon, 20.0% chromium, 35.03% nickel, 10.0% molybdenum, 0.5% to 0.82% titanium, 0.015% boron, 0% to 0.34% iron, and the balance cobalt, except for impurities.

6. The method as claimed in claim 4 wherein the cold working is in the range from 50% to 63% and the heat treating temperature is 1400° F. to 1450° F.

* * * * *